US006152574A

United States Patent [19]

Lin

[11] Patent Number: 6,152,574

[45] Date of Patent: Nov. 28, 2000

[54] DECORATING LAMP DEVICE

[76] Inventor: Jack Lin, No. 21, Alley 9, Lane 27, Sec. 5, Min Sheng E. Rd., Taipei, Taiwan

[21] Appl. No.: 09/258,876

[22] Filed: Feb. 26, 1999

[51] Int. Cl.[7] ..... F21V 11/00

[52] U.S. Cl. ..... 362/240; 362/101; 362/375

[58] Field of Search ..... 362/33, 101, 240, 362/247, 248, 374, 375

[56] References Cited

U.S. PATENT DOCUMENTS 1,579,649 4/1926 Cushway ..... 362/101

4,594,646 6/1986 Kohorn et al. ..... 362/101

*Primary Examiner*—Stephen Husar

*Attorney, Agent, or Firm*—Rosenberg, Klein & Lee

[57] ABSTRACT

A decorating lamp device comprises a body and a plurality of lamp sets. The body have a positioning seat and an upper cover being installed above the body. The top portion of the positioning seat projects from the top portion. A plurality of through holes with equal spaces are formed on the top cover; and a plurality of lamp sets spaced with each other are positioned on the periphery of the body. Each of the lamp set have the respective reflecting mask which is matched with the through holes of the upper cover. Each of the reflecting mask have a glass plate located thereabove and have a respective bulb seat. Each of the bulb seat is inserted with a bulb. Thereby, a container can be positioned on the decorating lamp device. The container is located on the top portion of the positioning seat and can be filled with water. When the bulbs of the plurality of lamp sets light up, the light can be projected to the container and water through the reflecting mask so that the container and the water present a state of emitting light. Thus, a wholly different visual effect more beautiful than the prior art lamp set is presented by the lamp device of the present invention.

5 Claims, 3 Drawing Sheets

DECORATING LAMP DEVICE

BACKGROUND OF THE INVENTION

1. Field of the Invention

The present invention relates to a decorating lamp, and especially to a lamp structure presenting a special visual effect and a preferred displaying effect.

2. Description of the Prior Art

With the improvement of human life, the lamp device is more and more popular. A beautiful decorating lamp device can present different visual effects to increase the beauty of the peripheral environment. However, the projection of light in the prior art lamp is dull and is lack of variations. Since the decorating lamps have potentially large demands. Thus, the inventor of the present invention makes his best to study the lamp structure, for example, wall lamps, hanging lamps, desk lamps, and land lamps, and has an eager desire to improve the light projecting effect in order to design a novel lamp which has various variations of light.

SUMMARY OF THE INVENTION

Another object of the present invention is to provide a decorating lamp device comprising a body and a plurality of lamp sets. The body have a positioning seat. An upper cover is installed above the body, and a top portion of the positioning seat projecting from the top portion. A plurality of through holes with equal spaces are formed on the top cover; and a plurality of lamp sets are spaced with each other and are positioned on the periphery of the body. Each of the lamp set having the respective reflecting mask which is matched with the through holes of the upper cover. Each of the reflecting mask have a glass plate located thereabove and have a respective bulb seat, each of the bulb seat is inserted with a bulb. Thereby, a container can be positioned on the decorating lamp device. The container is located on the top of the positioning seat and can be filled with water. When the bulbs of the plurality of lamp sets light up, the light can be projected to the container and water through the reflecting mask so that the container and the water present a state of emitting light. Thus, a wholly different visual effect more beautiful than the prior art lamp set is presented by the lamp device of the present invention.

The present invention will be better understood and its numerous objects and advantages will become apparent to those skilled in the art by referencing to the following drawings in which:

DETAILED DESCRIPTION OF THE PREFERRED EMBODIMENT

Figure 1:
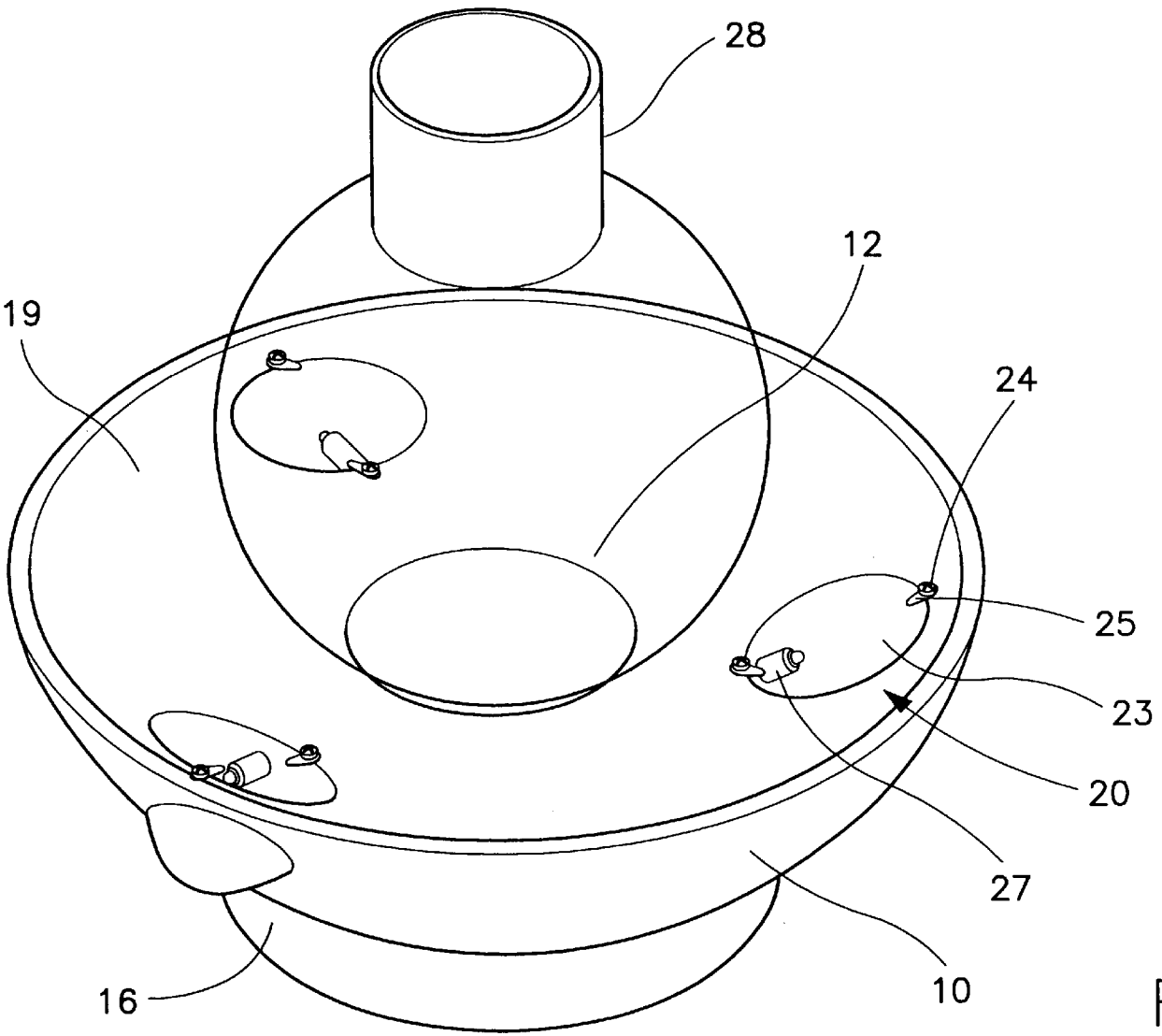
FIG. 1 is a perspective view of the present invention.
Figure 2:
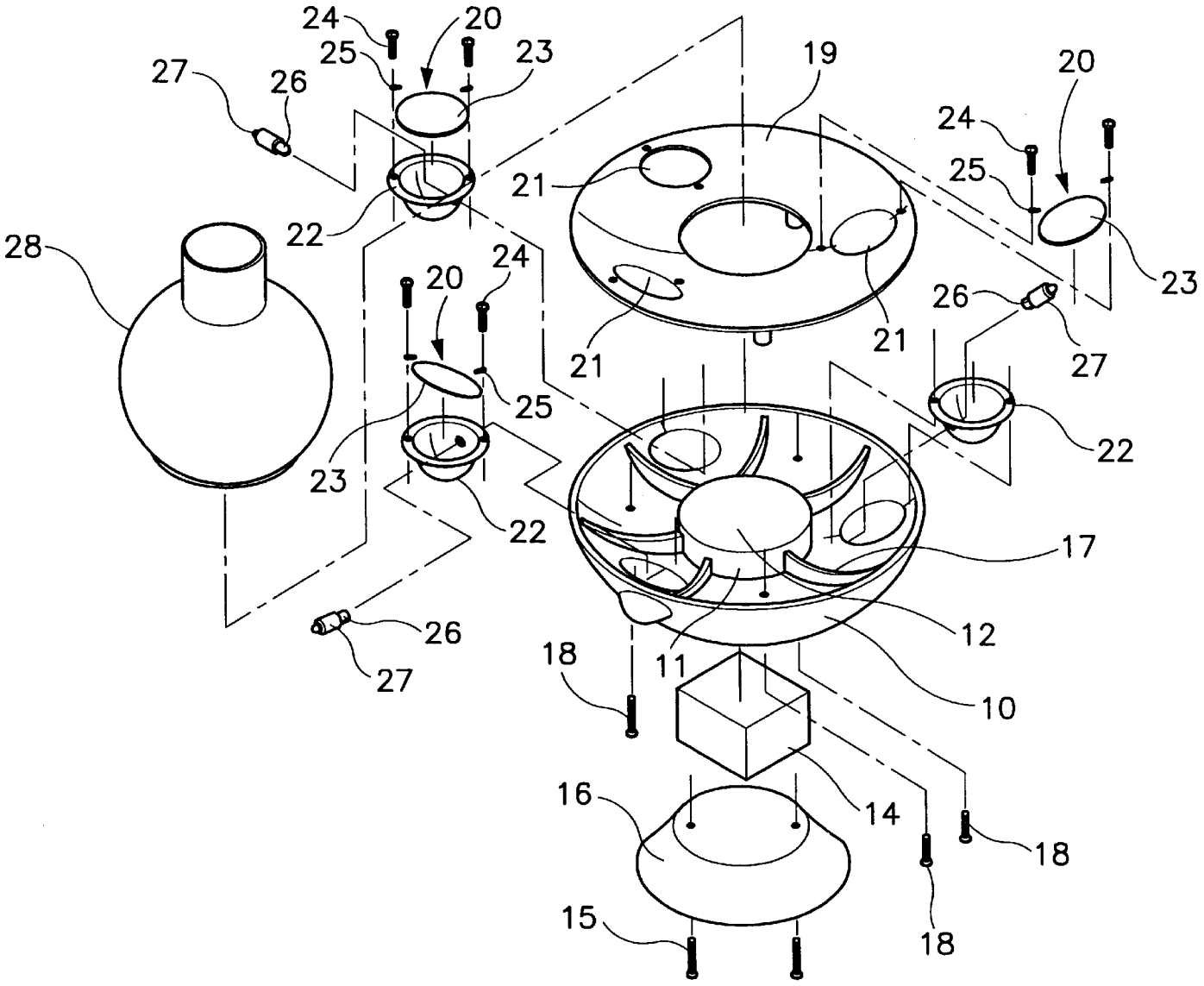
FIG. 2 is an exploded perspective view of the present invention.
Figure 3:
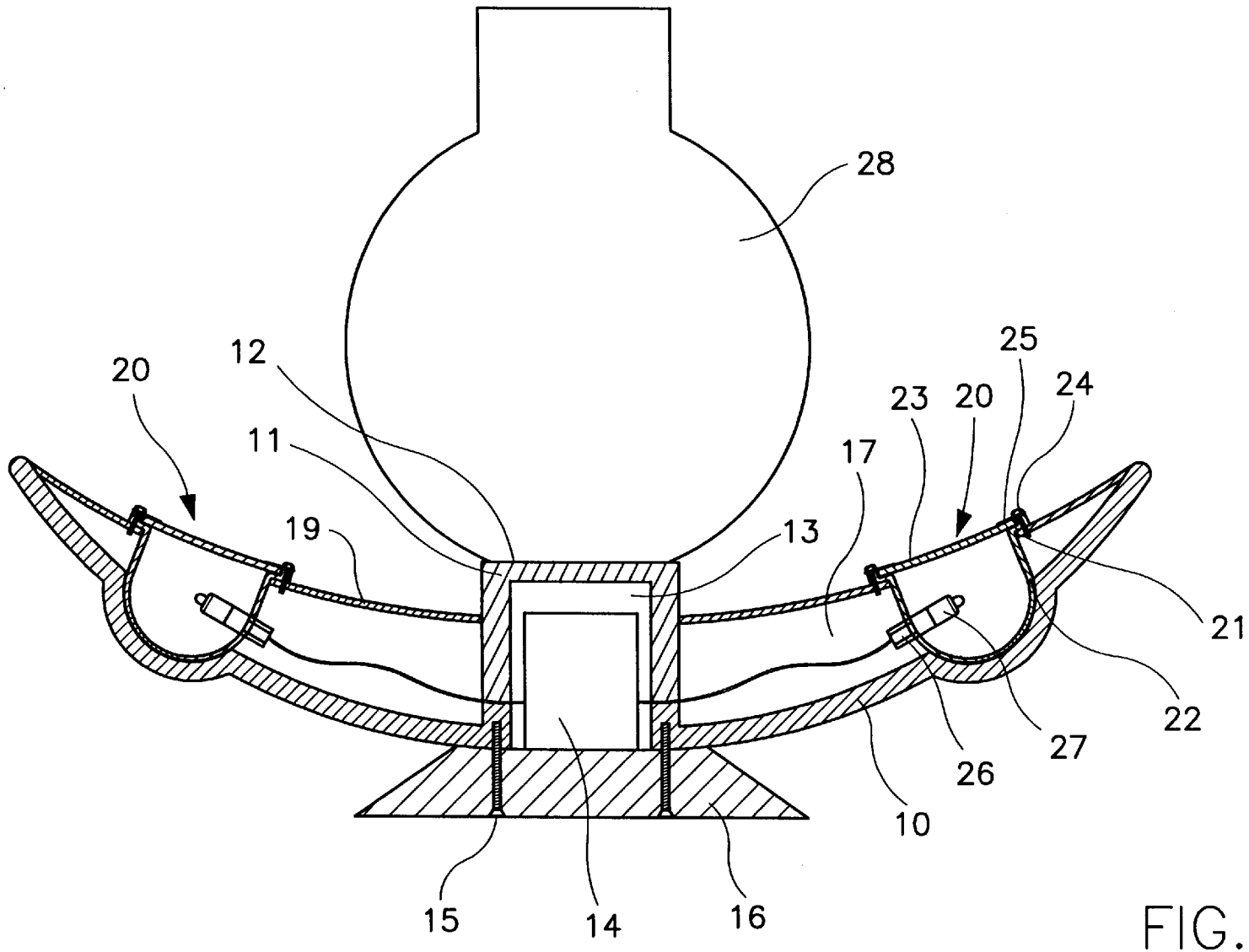
FIG. 3 is a plane cross sectional view of the present invention.

The present invention relates to a decorating lamp device comprising a bulb 10 and a plurality of lamp sets 20. The body 10 is a hollow case having a circular shape, an oblong shape or other shape. A positioning seat 11 is formed on the center of the body 10. The positioning seat 11 has a plane top portion 12. A hollow transformer chamber 13 is formed therewithin for receiving a transformer 14. The bottom of the transformer chamber 13 has an opening. A plurality of enhancing ribs 17 with a radiating arrangement are installed on the body 10. An upper cover 19 is locked above the body 10 by screws 18. The top portion 12 of the positioning seat 11 is protruded from the upper cover 19 with a proper height.

A plurality of lamp set 20 spaced with an equal space are installed on the outer periphery of the positioning seat 12 of the bulb 10. A plurality of circular through holes 21 spaced with an equal space are installed on the upper cover 19. Each of the through holes 21 matches with a cambered reflecting mask 22. A water-proof and dust-proof glass plate 23 is installed in a proper position above the reflecting mask 22. The reflecting mask 22 is locked to the upper cover 19 by a plurality of screws 24. Each of the screws 24 for locking the reflecting mask 22 is fixed with an buckling piece 25 for buckling the outer rim of the glass plate 23 so that the glass plate 23 can be fixed to the top portion of the reflecting mask 22. A bulb seat 26 is firmly secured to the reflecting mask 22. Each bulb seat 26 is inserted with a bulb 27 so that the bulb 27 is positioned with the reflecting mask 22. Power can be transferred to the transformer 14 through a power line (not shown) and then transferred to a bulb seat 26 and a bulb 27 for supplying power to the bulb 27. Therefore, a decorating lamp device of the present invention is assembled.

In the present invention, a container (for example, a bottle) 28 can be positioned on the decorating lamp device. The container 28 is located on the top 12 of the positioning seat 11. The container 28 may be used to arrange flowers and water can be fill into the container 28. When the bulbs 27 of the plurality of lamp sets 20 light up, the light can be projected to the container 28 and water through the reflecting mask 22 so that the container 28 and the water present a state of emitting light. Thus, a wholly different effect than the prior art lamp set is presented by the lamp device of the present invention.

Although the invention has been described in detail with reference only to a preferred embodiment, those skilled in the art will appreciate that various modifications can be made without departing from the invention. Accordingly, the invention is defined only by the following claims which are intended to embrace all equivalent thereof.

What is claimed is:

1. A decorating lamp device comprising:

a body having a positioning seat, an upper cover being installed above the body, a top portion of the positioning seat protrudes through a central opening of the upper cover, a plurality of through holes are formed in the upper cover in equidistantly spaced relationship; and a plurality of lamp sets spaced with each other and being positioned on a periphery of the body, each lamp set having a respective reflector matched with the through holes of the upper cover, each reflector having a glass plate located thereabove and having a respective bulb seat, each bulb seat having a bulb inserted therein.

2. The decorating lamp device as claimed in claim 1, wherein the top portion of the positioning seat is a plane.

3. The decorating lamp device as claimed in claim 1, wherein a transformer chamber is formed within the positioning seat for receiving a transformer, a lower cover is formed on the bottom of the transformer.

4. The decorating lamp device as claimed in claim 1, wherein a plurality of enhancing ribs are installed on the body.

5. The decorating lamp device as claimed in claim 1, wherein each reflector is locked to the upper cover by a plurality of screws, each of the screws is fixed with a buckling piece for buckling the outer rim of a respective glass plate.

* * * * *